US005172554A

United States Patent [19]

Swift et al.

[11] Patent Number: 5,172,554

[45] Date of Patent: Dec. 22, 1992

[54] SUPERFLUID THERMODYNAMIC CYCLE REFRIGERATOR

[75] Inventors: Gregory W. Swift, Santa Fe, N. Mex.; Vincent Y. Kotsubo, La Canada, Calif.

[73] Assignee: The United States of America as represented by the United States Department of Energy, Washington, D.C.

[21] Appl. No.: 679,498

[22] Filed: Apr. 2, 1991

[51] Int. Cl.[5] ..... F25B 9/00

[52] U.S. Cl. ..... 62/6; 62/51.3; 60/520

[58] Field of Search ..... 62/6, 51.3, 467; 60/520

[56] References Cited

U.S. PATENT DOCUMENTS

| | | | |
|---|---|---|---|
| 3,195,322 | 7/1965 | London | 62/467 |
| 3,896,630 | 7/1975 | Severijns et al. | 62/51.3 |
| 4,136,526 | 1/1979 | Chanin et al. | 62/51.3 |
| 4,136,531 | 1/1979 | Staas et al. | 62/51.3 |
| 4,300,360 | 11/1981 | Chanin et al. . | |
| 4,457,135 | 7/1984 | Hakaruku et al. | 62/3.1 |
| 4,499,737 | 2/1985 | Binnig et al. . | |
| 4,713,942 | 12/1987 | Hofmann | 62/51.3 |
| 4,770,006 | 9/1988 | Roach et al. | 62/51.3 |
| 4,953,366 | 9/1990 | Swift et al. . | |

OTHER PUBLICATIONS

John C. Wheatley, "Dilute Solutions of $^3$He in $^4$He at Low Temperatures," 36 Am. J. Phys. No. 3, pp. 181-210, Mar. 1986).

Ray Radebaugh, "Pulse Tube Refrigeration-A New Type of Cryocooler," 26 Jpn. J. Appl. Phys., Suppl. 26-3, pp. 2076-2087 Jun. 1987.

*Primary Examiner*—Ronald C. Capossela

*Attorney, Agent, or Firm*—Ray G. Wilson; Paul D. Gaetjens; William R. Moser

[57] ABSTRACT

A cryogenic refrigerator cools a heat source by cyclically concentrating and diluting the amount of $^3$He in a single phase $^3$He-$^4$He solution. The $^3$He in superfluid $^4$He acts in a manner of an ideal gas in a vacuum. Thus, refrigeration is obtained using any conventional thermal cycle, but preferably a Stirling or Carnot cycle. A single phase solution of liquid $^3$He at an initial concentration in superfluid $^4$He is contained in a first variable volume connected to a second variable volume through a superleak device that enables free passage of $^4$He while restricting passage of $^3$He. The $^3$He is compressed (concentrated) and expanded (diluted) in a phased manner to carry out the selected thermal cycle to remove heat from the heat load for cooling below 1 K.

18 Claims, 8 Drawing Sheets

SUPERFLUID THERMODYNAMIC CYCLE REFRIGERATOR

BACKGROUND OF INVENTION

This invention relates to cryogenic cooling and, more particularly, to cooling below 1 K using $^3$He as the working fluid. This invention is the result of a contract with the Department of Energy (Contract No. W-7405-ENG-36).

The routine use of temperatures below 1 K is vital in fields as diverse as particle physics, for cooling polarized targets and advanced detectors; astronomy, for cooling infrared detectors; surface chemistry, for enhancing NMR sensitivity; materials science; and condensed-matter physics. However, such temperatures can be reached only by using helium or magnetic materials, because only these materials have useful amounts of entropy below 1 K.

There have been three methods for refrigerating below 1 K: dilution refrigeration, $^3$He evaporation, and adaiabatic demagnetization. These three methods are discussed in O. V. Lounasmaa, *Experimental Principles and Methods Below 1 K*, Academic Press (1974), incorporated herein by reference. The method most often used for cooling below 1 K is liquid helium dilution refrigeration, where the refrigeration is produced by the endothermic heat of mixing of liquid $^3$He and liquid $^4$He. Properties of $^3$He-$^4$He mixtures at these temperatures and dilution refrigeration are discussed in J. C. Wheatley, "Dilute Solutions of $^3$He in $^4$He at Low Temperatures", 36 Am. J. Phys., No. 3, pp. 181-210 (March 1968), incorporated herein by reference. Dilution refrigeration requires a two-phase regime where $^3$He can be dissolved in and separated from a $^3$He-$^4$He solution for cooling and recycling, respectively.

All of these methods have substantial drawbacks for various applications. $^3$He evaporation refrigeration is limited to temperatures above 0.3 K. Dilution refrigeration does not work well in space, where it requires elaborate phase boundary controls. Adiabatic demagnetization of a paramagnetic salt requires large magnetic fields that can be detrimental to applications involving other magnetic fields, e.g., NMR, or sensitive electronic components, such as used in particle physics research. All of these methods are inefficient and the working apparatus is complex.

These problems are addressed by the present invention wherein $^3$He acts like an "ideal gas" in a thermodynamic refrigeration cycle. Accordingly, it is an object of the present invention to use $^3$He in superfluid $^4$He as the working fluid in a single phase thermodynamic cycle refrigerator.

Another object of the present invention is to provide for cooling below 1 K using $^3$He in a zero gravity environment.

One other object of the present invention is to provide alternate refrigerators for reaching temperatures below 1 K that do not use magnetic fields.

Still another object of the present invention is to provide a simple, relatively efficient refrigerator for cooling below 1 K.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE INVENTION

To achieve the foregoing and other objects, and in accordance with the purposes of the present invention, as embodied and broadly described herein, the apparatus of this invention may comprise a refrigerator for cryogenic cooling. A single phase solution of liquid $^3$He at an initial concentration in superfluid $^4$He is contained in a pump having a first variable volume. A second variable volume of the pump contains $^4$He. Superleak means connects the first and second variable volumes for cyclically varying the concentration of $^3$He in the first volume for cyclically heating and cooling the solution in the first volume. At least one heat exchanger is operatively connected with the first volume for thermal energy exchange with the first volume.

In another characterization of the present invention, the apparatus may comprise a Stirling cycle refrigerator having a compressor, an expander, a regenerator therebetween, and a working fluid for cooling the expander. The improvement of the present invention is a working fluid comprising a single phase solution of liquid $^3$He at a selected initial concentration in superfluid $^4$He.

One other characterization of the present invention is a method for cryogenic cooling. A single phase solution of liquid $^3$He in superfluid $^4$He is established at an initial concentration. The concentration of $^3$He in the first volume is cyclically varied while maintaining the single phase solution for cyclically heating and cooling the solution in the first volume.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings.

DETAILED DESCRIPTION OF THE PRESENT INVENTION

Figure 1A:
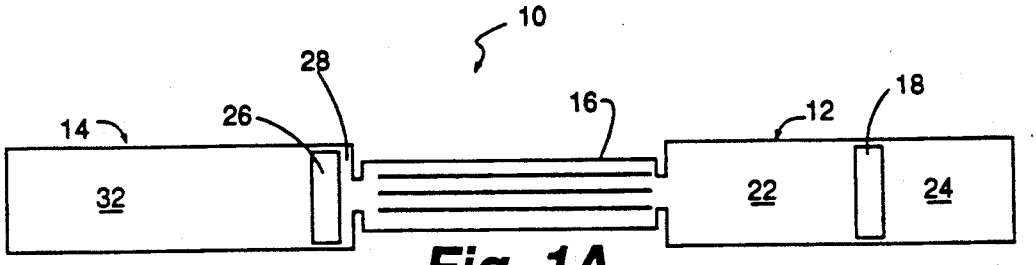
FIGS. 1A-E are schematic drawings of a Stirling refrigeration cycle according to the present invention.

The present invention is directed to a new refrigeration cycle using the unique quantum properties of a single phase solution of $^3$He in $^4$He to obtain a superfluid thermodynamic cycle refrigerator ("STR"). The existence of heliums as liquids, not solids, near 0 K is a consequence of the large deBroglie wavelength of these low-mass atoms; below about 1 K the deBroglie wavelength of helium atoms with thermal velocities is as large as the interparticle separation in the liquids. The properties of liquid helium then depend on the quantum states of the interacting many-body system, instead of motions of separate atoms. Thus, the fact that $^4$He atoms obey Bose statistics while $^3$He atoms obey Fermi statistics largely determines the macroscopic behavior of the two liquids. Pure $^4$He, forming a Bose liquid, undergoes a superfluid transition at 2.2 K and below 1 K it is essentially in its quantum ground state. It has no entropy, and flows without dissipation; thermodynamically it is a vacuum.

In a dilute solution of $^3$He in such superfluid $^4$He, the $^3$He atoms behave like a classical ideal gas, with a heat capacity of $(3/2)k_B$ per atom and an equation of state $P_{os}=n_3k_BT$, where $k_B$ is Boltzmann's constant, $P_{os}$ is the osmotic pressure, $n_3$ is the $^3$He atom number density, and T is the temperature. At lower temperatures, below about 0.1 K, the deBroglie wavelength is as large as the spacing between $^3$He atoms even in a dilute solution and the Fermi statistics of the $^3$He atoms dominate. Then the $^3$He behaves like a Fermi gas instead of a classical gas.

A STR according to the present invention uses this superfluid $^3$He-$^4$He solution as a thermodynamic working medium, cyclically compressing and expanding the $^3$He solute alone, i.e., concentrating and diluting the $^3$He in superfluid $^4$He, to produce heating and cooling. While the thermodynamic cycle discussed below is the Stirling cycle, the $^3$He solute is suitable for use in any thermodynamic cycle using gas expansion and compression, e.g. the Carnot or Brayton cycle. The Stirling cycle is a preferred cycle because suitable components are readily adaptable to low temperature operation and because there are configurations of the Stirling-cycle refrigerator that require no moving parts (see, e.g., U.S. Pat. Nos. 4,953,366 and 4,858,441, incorporated herein by reference). A STR, as hereinbelow described, has reached 0.6 K from a starting temperature of 1.2 K, with a cooling power of tens of $\mu$W at the lowest temperature.

Referring now to FIGS. 1A-E, there is shown a pictorial illustration of one embodiment of a STR, an ideal Stirling-cycle refrigerator 10, using $^3$He-$^4$He as a working fluid. The basic Stirling cycle is a four step cycle of isothermal compression, constant-volume regenerative heat rejection, isothermal expansion, and a constant volume regenerative heat absorption. Hot compressor 12 and cold expander 14 are connected through regenerator 16. Compressor 12 and expander 14 have pistons 18 and 26 that are driven cyclically, but out of phase, so that the working fluid undergoes cyclic compressions and displacements through regenerator 16. Regenerator 16 is a thermal reservoir that cyclically exchanges heat with the working fluid. Regenerator 16 maintains a temperature difference between compressor 12 and expander 14 by having a low longitudinal thermal conductivity and a large heat capacity and high transverse thermal conductivity. As the fluid is displaced from the compressor to the expander, the fluid is cooled to the expander temperature before it enters the expander.

In accordance with the present invention, STR 10 must accommodate $^3$He-$^4$He as the working fluid. Pistons 18 and 26 must work on the $^3$He solute only, and not on the relatively incompressible bulk $^4$He liquid. Thus, pistons 18 and 26 are superleak pistons that allow the superfluid $^4$He component to flow through so that a displacement of the piston compresses or expands only $^3$He. Compressor 12 and expander 14 each define a working fluid, $^3$He-$^4$He, volume 22, 28 and a bulk $^4$He fluid volume 24, 32. It will be understood that the bulk fluid in volumes 24 and 32 may contain only $^4$He or may contain some solution of $^3$He in $^4$He. The $^3$He in the bulk fluid volume is not a part of the refrigeration process herein described. Pistons 18 and 26 reciprocate freely through the superfluid $^4$He while compressing and expanding $^3$He, i.e., concentrating and diluting $^3$He in volumes 22 and 28.

FIG. 1A depicts a Stirling refrigerator at the beginning of a cooling cycle. Volumes 22 and 28 are filled with a solution of $^3$He in $^4$He at a predetermined concentration effective to maintain a single phase working fluid at the expected operating temperatures.

Figure 2:
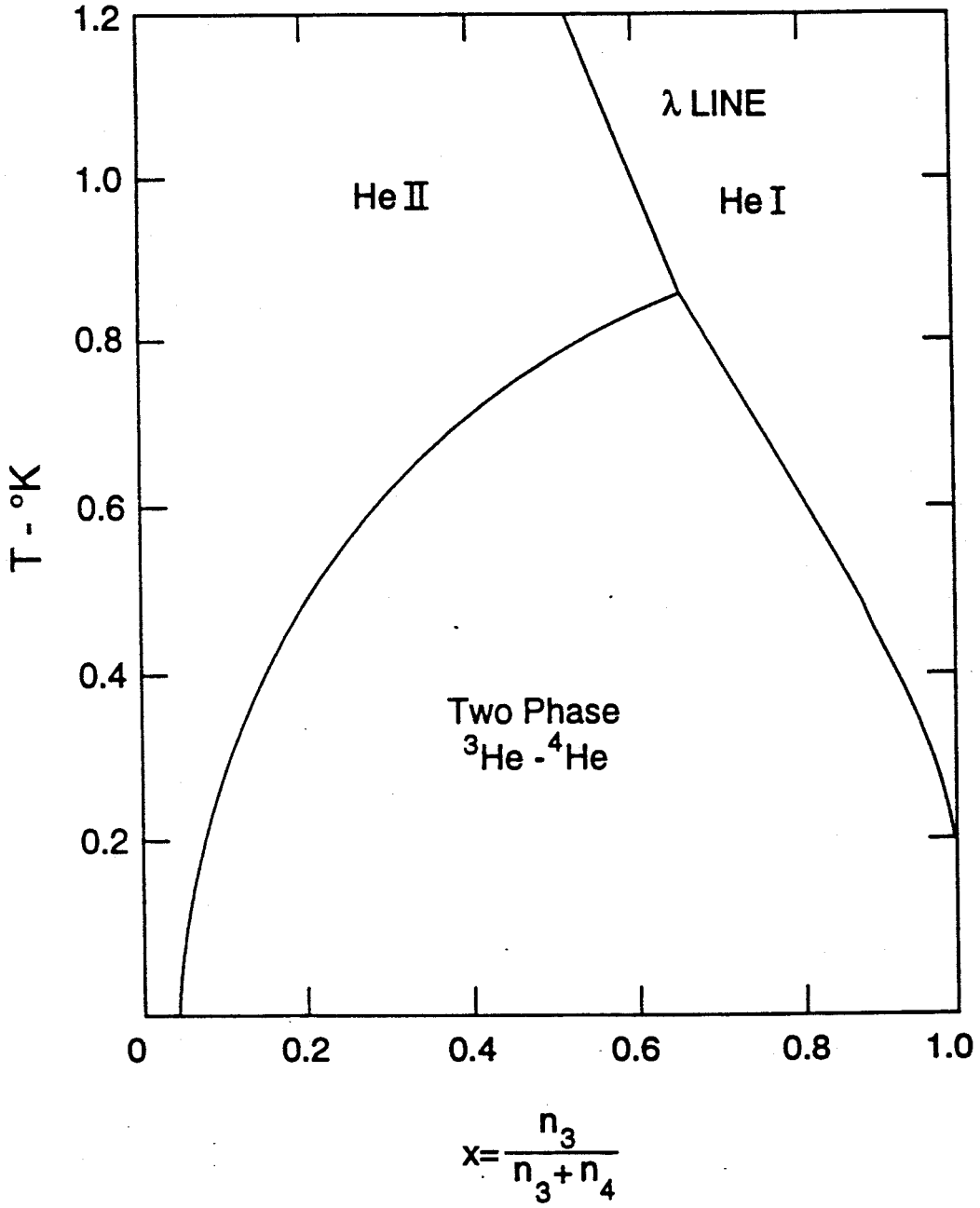
FIG. 2 is a $^3$He-$^4$He phase separation diagram.

It will be appreciated that the $^3$He solute can form a more concentrated liquid phase above the $^3$He-$^4$He solution under certain conditions of temperature and concentration. A $^3$He-$^4$He phase diagram, Wheatley supra. at p. 185, is shown in FIG. 2, where the regimes marked He II and He I are superfluid and normal single phase regimes, respectively, and the regime therebetween is a two phase regime. However, concentrations of $^3$He exist to maintain a single phase superfluid solution down to a selected operating temperature, down to even 0 K. The present invention provides only a single phase solution as the working fluid.

Figure 1B:
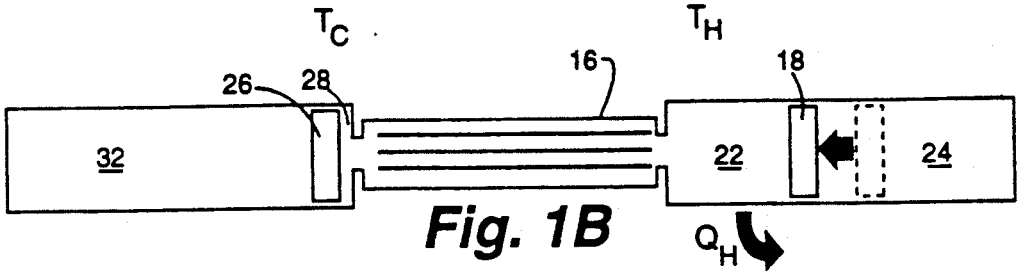
Figure 1C:
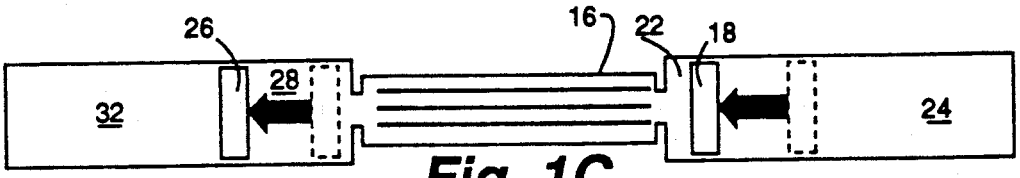

FIG. 1B shows the isothermal compression of $^3$He in the working fluid in volume 22, where the bulk superfluid $^4$He flows through a superleak element, preferably contained in piston 18, and is retained in volume 24. It will be understood that $^4$He can communicate between volume 22 and volume 24 by any superleak device that connects the volumes, e.g., by a superleak in an external tube connecting volume 22 with volume 24. The heat of compression $Q_H$ is removed from the refrigerator by an external heat sink (not shown) at temperature $T_H$. In FIG. 1C, pistons 18 and 26 both move, displacing the working fluid from compressor 12 to expander 14 through regenerator 16. Regenerator 16 provides good lateral thermal contact with the $^3$He-$^4$He working fluid moving through regenerator 16 so that heat is transferred from the working fluid to regenerator 16. The high heat capacity of regenerator 16 provides locally isothermal conditions, reversibly cooling the temperature of the working fluid from $T_H$ to $T_C$ during movement from compressor 12 to expander 14.

Figure 1D:
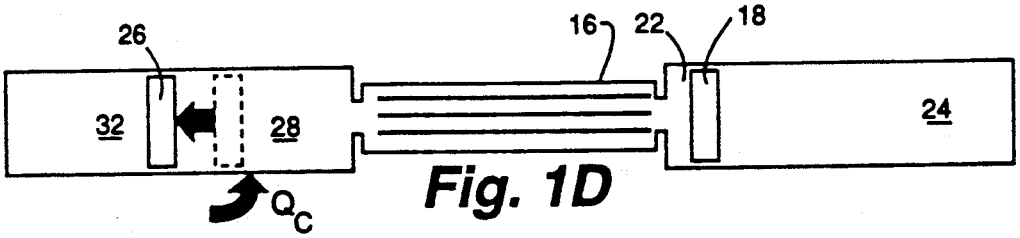
Figure 1E:
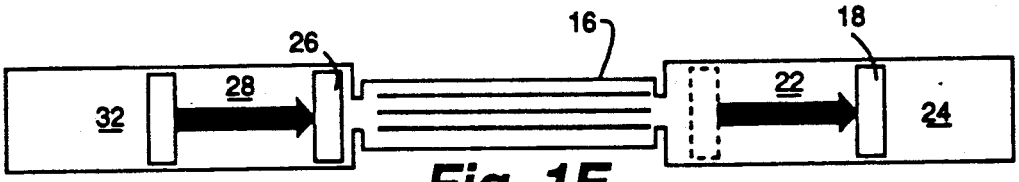

FIG. 1D then shows an isothermal expansion of the $^3$He, where heat $Q_C$ is absorbed as the $^3$He is diluted by $^4$He moving from volume 32 to expanding volume 28 through superleak piston 26. In the fourth step, shown in FIG. 1E, pistons 18 and 26 move to displace the $^3$He-$^4$He working fluid from expander 14 to compressor 12, where regenerator 16 transfers heat to the laterally moving working fluid, returning the fluid temperature from $T_C$ to $T_H$.

Figure 3:
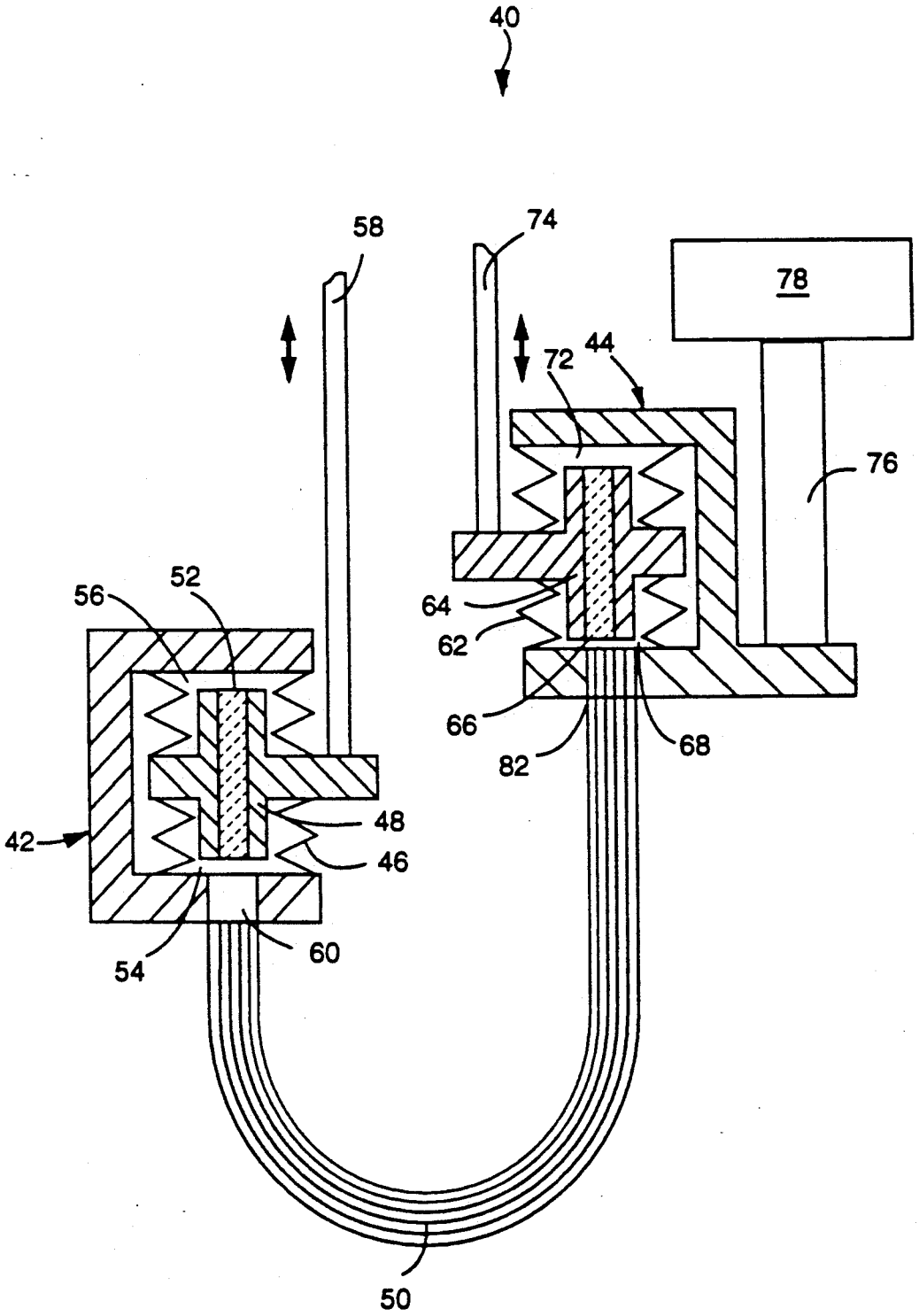
FIG. 3 is a cross-sectional view of one embodiment of a refrigerator using a single phase $^3$He-$^4$He solution as the working fluid.

Referring now to FIG. 3, there is shown one embodiment of the STR described in FIGS. 1A-E. Refrigerator 40 includes compressor 44 and expander 42 connected through regenerator 50. Compressor 44 is composed of bellows 62 (Servomotor FC-16 nickel bellows) and copper piston 64 with superleak channel 66. Piston 64 is driven by reciprocating rod 74. Bellows 62 and piston 64 define two variable volumes: working fluid volume 68 and bulk fluid volume 72. The total fluid volume within each bellows 62, 46 is about 2 $cm^3$. Volume 68 is closed with a ported flange 82 comprising 19 0.8 mm dia. holes drilled in a 1 cm thick copper flange to act as a heat exchanger for removing the heat generated by $^3He$ compression. Ported flange 82 is connected to a 1.91 cm dia., 18 cm long copper tube 76 filled with pure $^4He$ that acts as both a thermal reservoir and a thermal link to a standard pumped $^4He$ coldplate 78 that provides a starting temperature of about 1.2 K.

Expander 42 likewise includes bellows 46, copper piston 48 with superleak channel 52 and reciprocating rod 58. Bellows 46 defines working fluid volume 54 and bulk fluid volume 56. Working fluid volume 54 is closed with ported flange 60 open to regenerator 50. The expander heat load is simply the heat capacity of expander 42. Expander 42 is thermally isolated from compressor 44 by three 25 cm long, 0.64 cm OD thinwall stainless steel support tubes (not shown).

Superleak channels 52 and 66 are each filled with 4.65 cm long, 0.36 cm dia. rods of microscopically porous Vycor glass (Corning 7930) sealed with Stycast 2850 epoxy. Vycor glass has channel diameters of about $10^{-8}$ m that viscously lock the $^3He$ solute, allowing only the superfluid $^4He$ component to flow through, whereby a displacement of the corresponding piston compresses or expands only the $^3He$.

Reciprocating rods 58, 74 are driven by a camshaft and dc motor/gearbox (not shown) at a room temperature location. Each drive rod 58, 74 consists of a 1.77 mm OD stainless tube inside of a 2.4 mm OD, 1.8 mm ID stationary tube, bent slightly where necessary. The cams are 5.08 cm dia. ball bearings mounted 0.32 cm off center to provide 0.64 displacements. The cams are mounted on separate, but colinear, driveshafts connected by a clamp, so that the phase between the cams can be adjusted by loosening the clamp and rotating one cam with respect to the other. Final volume displacements by the reciprocating pistons 64. 48 are cyclical and about 0.9 $cm^3$/stroke, but vary somewhat between pistons and the resulting motions are hysteretic and non-sinusoidal in the non-ideal model described herein.

Regenerator 50 is an array of thirty CuNi capillaries, each 0.20 mm ID, 0.37 mm OD, 38 cm long, stuffed into a series arrangement of a 0.47 cm dia., 2.86 cm long CuNi tube, a 6.35 mm OD, 25 cm long stainless steel tube, a 6.35 cm long section of 0.64 cm OD, 0.32 cm ID bellows, and a 0.32 cm dia., 2.5 cm long CuNi tube, all sealed together with soft solder. The bellows form a U-shaped bend to allow regenerator 50 to match ported flanges 60 and 82 in expander 42 and compressor 44, respectively. The capillaries are sealed at the ends of the outer tube assembly with soft solder so that the $^3He$-$^4He$ solution can flow through the capillaries. The outer tube assembly is filled with pure $^3He$ to immerse the capillaries in a high heat capacity reservoir. The total heat capacity of regenerator 50 is calculated to be 1.1 J/K at 0.6 K and 1.2 J/K at 1 K.

Two separate fill lines (not shown) are used to fill refrigerator 40. One line fills working volumes 54 and 68 and regenerator 50. Another fill line is connected to bulk $^4He$ volumes 56 and 72 to allow the $^3He$ concentrations in each volume to be separately determined. The fill lines are closed during operation with low-temperature valves pneumatically operated with pressurized $^4He$ to reduce heat leaks.

Figure 4:
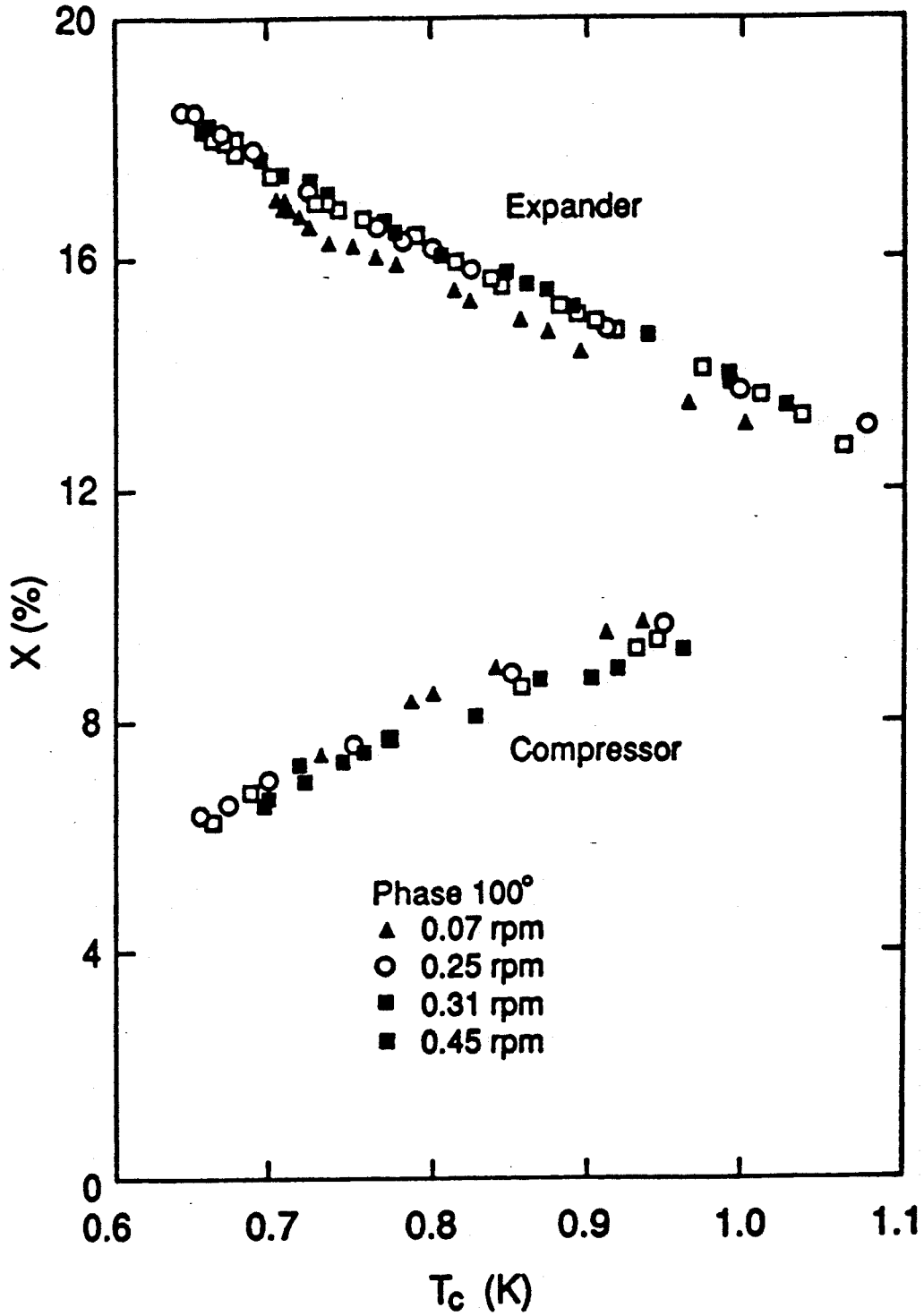
FIG. 4 graphically depicts the average $^3$He concentration in the expander and compressor as a function of expander temperature, taken at four different speeds.

In one series of experimental operations, refrigerator 40 was filled with a 12% $^3He$ solution in working fluid volumes 54, 68 and bulk fluid volumes 56, 72. The thermodynamic properties of the $^3He$ solute deviate slightly from ideal-gas behavior at this high concentration, but the cooling power at high temperature was increased. FIG. 4 shows the average $^3He$ concentration in the working fluid in expander 42 and compressor 44 as a function of expander 42 temperature for speeds of 0.07, 0.25, 0.31, and 0.45 rpm. For ideal-gas behavior, the relation between the temperatures and concentrations would be $X_cT_c=X_hT_h$, where $X_c$ and $X_h$ are the concentrations in expander 42 and compressor 44 and $T_h$ is the average compressor 44 temperature. In FIG. 4, $X_cT_c \simeq 1.6X_hT_h$. The deviation from ideal-gas behavior is partly due to the $^3He$ solute showing slight effects of the Fermi degeneracy and mostly due to "heat flushing." In the heat flush effect, the presence of a temperature gradient causes the $^4He$ normal-fluid excitations to flow down the temperature gradient, and the superfluid component to flow up the temperature gradient, with superfluid-normal fluid conversion taking place at the heat source and sink. The $^4He$ normal fluid drags $^3He$ atoms along with it, causing an excess buildup of $^3He$ atoms at the cold end.

Figure 5:
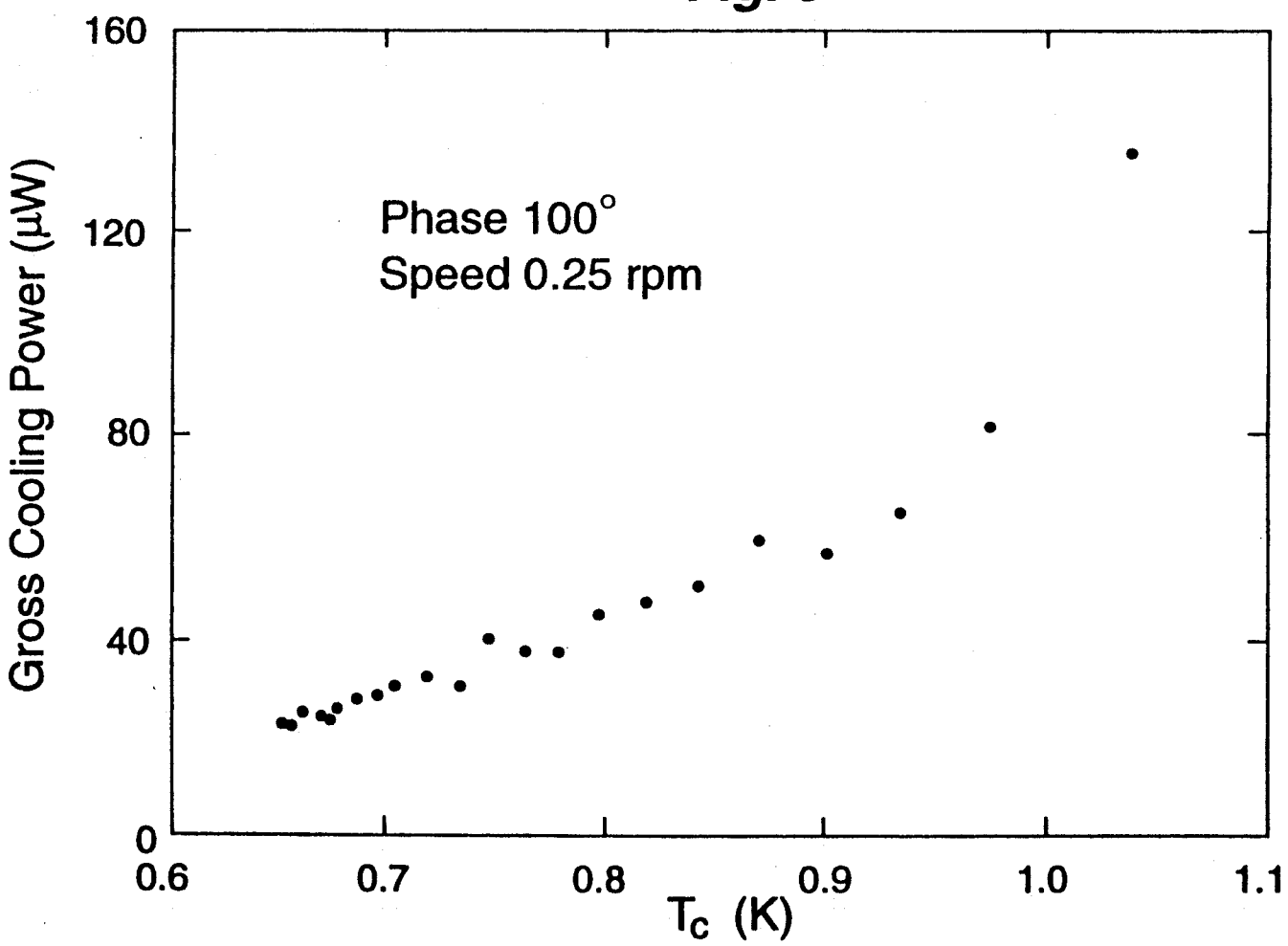
FIG. 5 graphically depicts the gross cooling power of the refrigerator shown in FIG. 3 as a function of temperature.

The gross cooling power of the refrigerator is shown in FIG. 5 as a function of temperature. The net cooling power was first determined from cooling rate data, using the measured heat capacity of expander 42 (FIG. 3), adding the calculated heat capacity of ½ the regenerator, and then multiplying by the rate of change of temperature. To obtain the gross cooling power, the net cooling power was corrected by 33 μW/rpm due to heating from the bellows motion as determined by running expander 42 with no liquid in the refrigerator; and for thermal conduction down the regenerator, support structure, and fill lines of 11.5 μW/K, determined by measuring the warmup rate with the refrigerator not running.

The lowest average temperature of about 0.65 K was reached during these runs with the phase between cams set at about 100°. In a subsequent run, with a bulk superfluid having a 2% $^3He$ concentration and a working fluid having a 10% $^3He$ concentration, a low temperature of 0.59 K was reached. Peak-to-peak concentration amplitudes were about 0.45 of the average concentration, and peak-to-peak temperature amplitudes on expander 42 at the lowest temperatures were about 50 mK.

Figure 6:
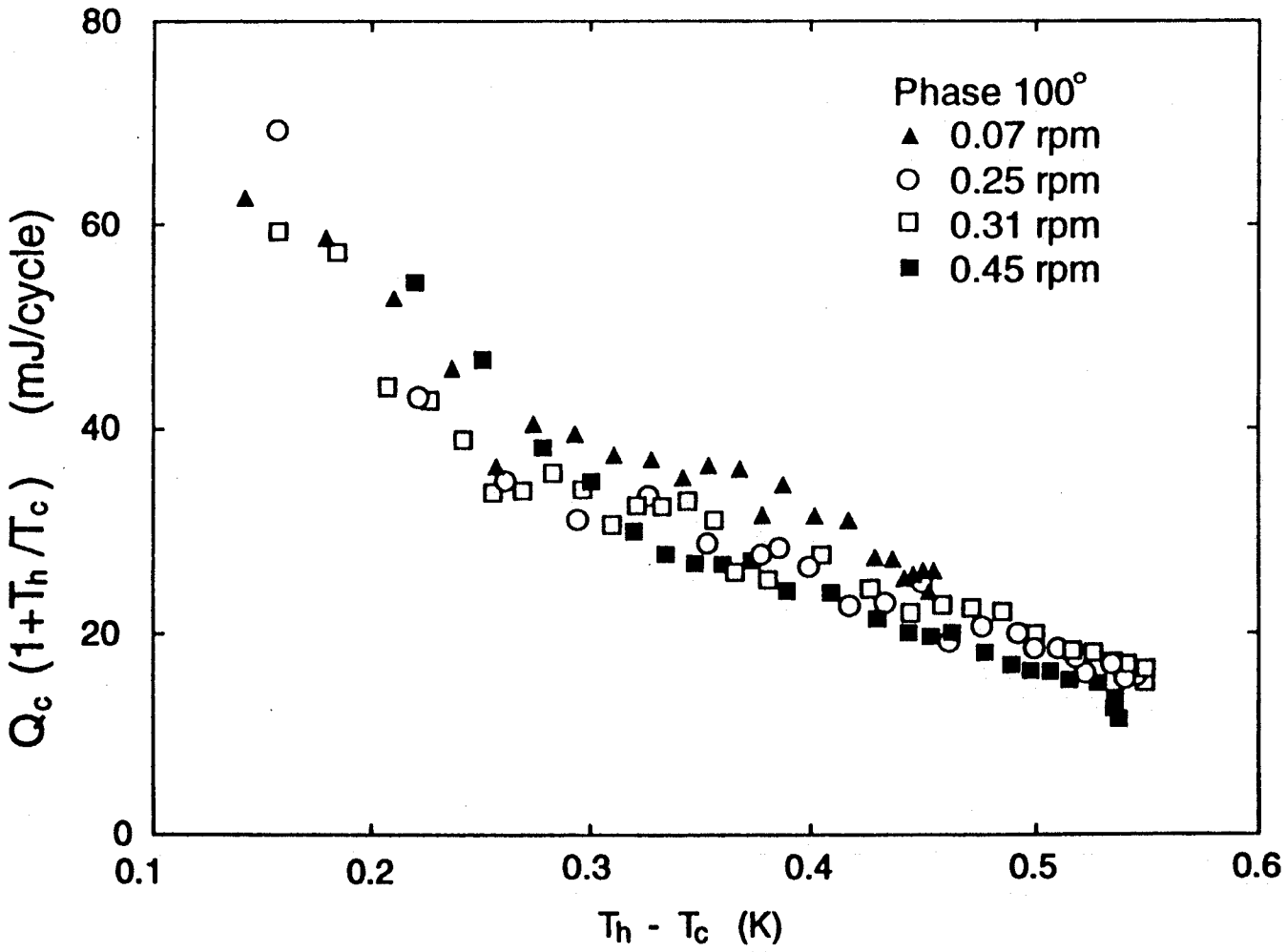
FIG. 6 graphically depicts a figure of merit defined as $Q_c(1+T_h/T_c)$ as a function of the temperature difference between the compressor and expander.

FIG. 6 displays a figure of merit, $Q_c(1+T_h/T_c)$ as a function of temperature difference between expander 42 and compressor 44. $Q_c$ is heat per cycle removed by expander 42, obtained by dividing the measured cooling power shown in FIG. 5 by the operating frequency. In a classical-gas Stirling cycle, with given volume displacements in the expander and compressor, a 90° phase shift between the two, and negligible regenerator volume, the cooling per cycle is frequency independent and the figure of merit is temperature independent. As shown in FIG. 6, the refrigerator shown in FIG. 3 obtained a figure of merit with a slight frequency dependence and a large temperature dependence.

There are several possible inefficiencies and irreversible mechanisms in the disclosed embodiment of the present invention. One likely source of inefficiency is dependence of the heat capacity of the $^3He$ solute on number density. As the $^3He$ concentration increases, the heat capacity per $^3He$ atom deviates from the ideal gas value of $(3/2)k_bT$. This causes a parasitic flow of heat down the regenerator since the heat capacity, and therefore the amount of heat transported, is different on the high concentration and low concentration strokes of a cycle. This heat load is estimated to be about 20 mJ/cycle.

An irreversible mechanism in the subject refrigerator is irreversible heat transfer across finite temperature differences, i.e., lack of isothermal conditions. There are other effects such as superfluid turbulence, heat-flush effects, and the $^4$He normal-fluid excitations, which are numerous near 2 K.

There are many improvements in the STR that might be made. Two-stage STR's might reach very low temperatures. Two STR's running at the same average temperatures, but 180° out of phase could regenerate each other, thereby eliminating the pure $^3$He high-heat-capacity reservoir. Moving parts at the expander, i.e., at $T_c$, might be eliminated by incorporating an orifice-pulse tube configuration such as shown in U.S. Pat. No. 4,953,366.

Figure 7:
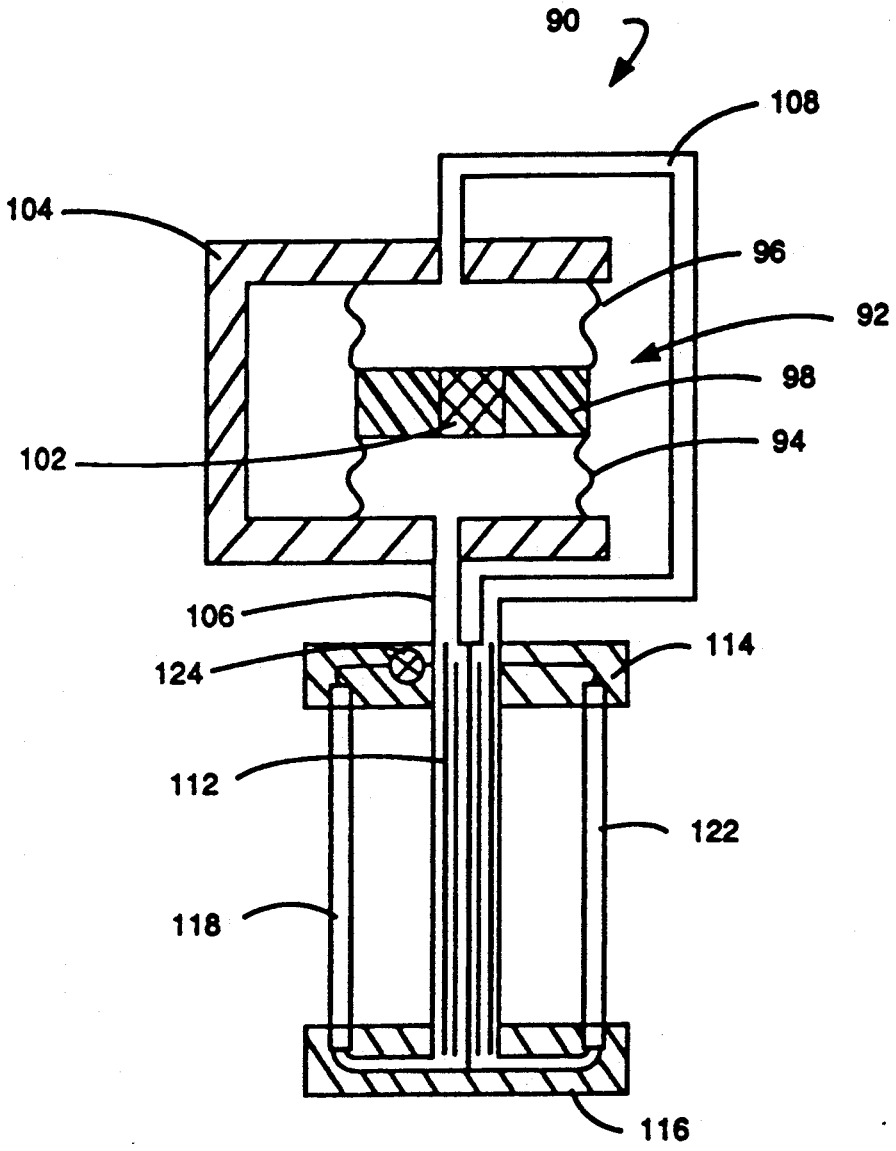
FIG. 7 is a cross-sectional illustration of a pulse tube embodiment of the present invention.

A pulse tube refrigerator 90 version of the STR is shown in FIG. 7. Pulse tubes are used in a Stirling cycle refrigerator to replace a displacer that introduces a volume variation 90° out of phase with the compressor volume variation so that gas moving through a connecting regenerator is compressed at the compressor end (hot end) and expanded at the displacer end (cold end). A pulse tube is connected to the output end of a regenerator and has an open end connected to the regenerator and a closed end. During a compression part of the Stirling cycle, any element of gas in the pulse tube moves toward the closed end and at the same time experiences a temperature rise due to the adiabatic compression. During a plateau in the pressure oscillation, the gas is cooled somewhat by heat transfer to the tube walls. In the expansion part of the cycle, the same element of gas moves toward the open end of the pulse tube and experiences a cooling due to the adiabatic expansion. During the next plateau, the gas is warmed through heat transfer from the tube walls adjacent the open end. Thus, each element of gas transfers heat toward the closed end of the pulse tube. A more thorough discussion of pulse tube refrigerators is found in Radebaugh, "Pulse Tube Refrigeration—A New Type of Cryocooler," 26 Jpn. J. Appl. Phys., Suppl. 26-3, pp. 2076–2087 (1987), incorporated herein by reference.

Pulse tube refrigerator 90 includes pump 92, counter flow regenerator 112, pulse tubes 118 and 122, "hot" heat sink 114 and "cold" heat sink 116. Pump 92 may be formed from bellows 94 and 96 with superleak piston 98 therebetween. Pump 92 is supported within support structure 104 with openings therethrough for $^3$He–$^4$He passage between the volumes defined by bellows 96 and 94 and counterflow regenerator 112. Piston 98 includes a superleak passage 102, as hereinabove described, and is reciprocated by a cycling rod (not shown) or the like.

The $^3$He–$^4$He solution has a $^3$He concentration to maintain single phase conditions at the selected operating temperatures for refrigerator 90. The $^4$He acts as a medium for the $^3$He and simply moves through superleak passage 102 during oscillation of piston 98. The $^3$He does not move through superleak passage 102 and is alternately concentrated (compressed) and diluted (expanded) within bellows 96 and 94 acting in 180° relationship.

It will be understood that the refrigerator defined by bellows 94, hydraulic connecting line 106, regenerator 112, pulse tube 118, and heat sinks 116 and 124 operates independent from the refrigerator defined by bellows 96, hydraulic connecting line 108, regenerator 112, pulse tube 122, and heat sinks 116 and 124. Thus, the two refrigerators operate 180° out of phase and are connected by orifice 124. As described in the '366 patent, supra, orifice 124 regulates $^3$He flow in and out of pulse tubes 118 and 122 at a phase effective to obtain the required heat removal. It will be appreciated that orifice 124 can be replaced with individual orifices and reservoir volumes if individual cooling loads are provided that require independent control.

Figure 8:
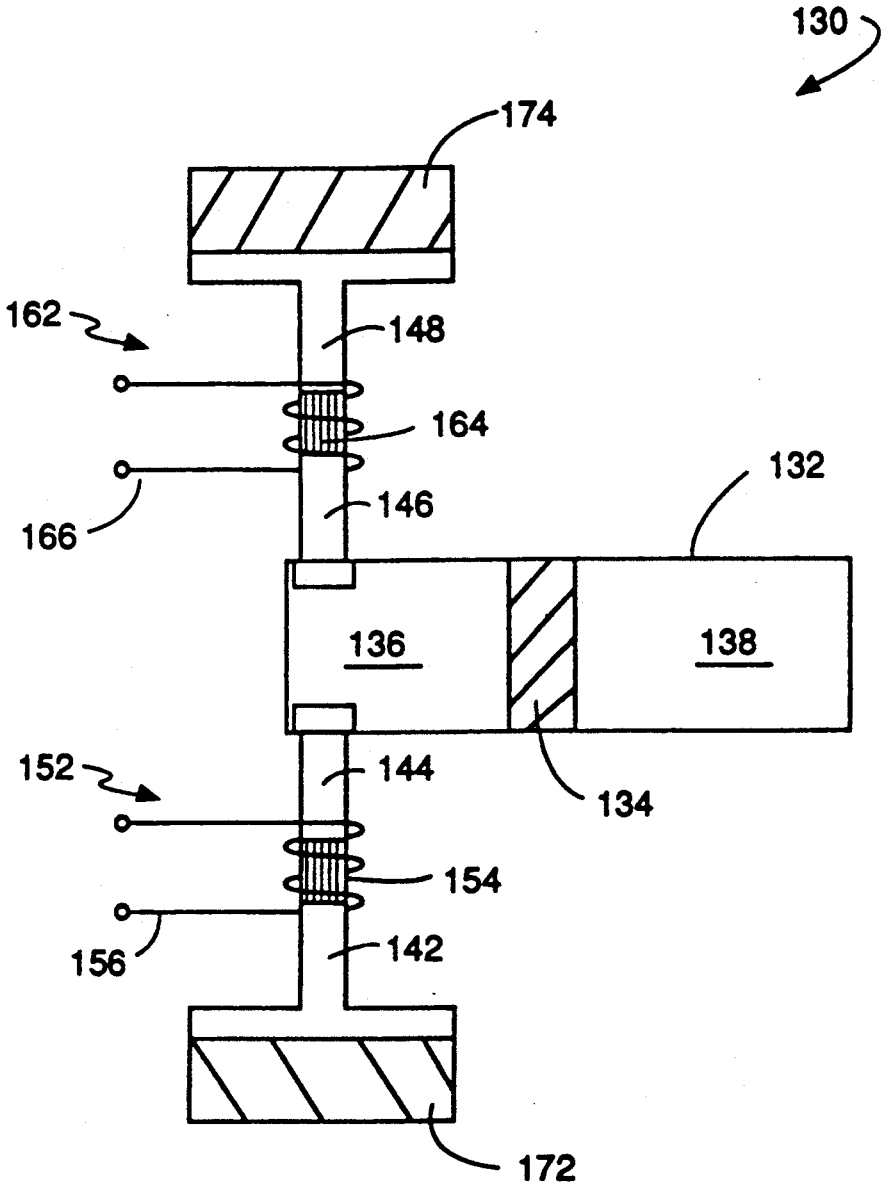
FIG. 8 is a schematic illustration of a superfluid refrigerator according to the present invention that uses a Carnot thermal cycle.

FIG. 8 schematically illustrates an embodiment of a STR using a Carnot thermal cycle. Carnot cycle refrigerator 130 includes $^3$He–$^4$He solution pump 132 with working fluid volume 136 and bulk fluid volume 138 separated by superleak piston 134, as herein above explained. The $^3$He–$^4$He working solution in working volume 136 is thermally linked to either refrigeration load 172 or heat sink 174 by thermal circuits comprising heat conductors 142, 144 with thermal switch 152 and heat conductors 146, 148 with thermal switch 162, respectively. Each thermal switch 152. 162 includes a length of superconducting material 154, 164, such as lead, surrounded by a solenoid coil 156, 166. Energizing a solenoid coil 156, 166 applies a magnetic field to the internal superconductor length 154, 164 effective to drive the superconductor to a normal conductivity with a concomitant increase in the thermal conductivity by some orders of magnitude. Superconducting heat switches are discussed in Lounasmaa, supra, at pages 260–262, and heat switches generally at pages 257–263, incorporated herein by reference.

A typical Carnot cycle involves the following steps starting with piston 134 moved to the maximum volume of working fluid volume 136, i.e., the most dilute concentration of $^3$He in the $^4$He superfluid, and with the working fluid at a selected temperature, e.g., 0.05 K:

1. With both heat switches 152, 162 open, i.e., no current in the associated solenoids 156, 166, piston 134 is moved to an intermediate position, adiabatically compressing the $^3$He in working fluid volume 136 so that its temperature rises, e.g. from 0.05 K to 1 K.

2. Close heat switch 162 by passing current through solenoid 166 and complete movement of piston 134 into volume 136, compressing the $^3$He in volume 136 isothermally, e.g. at 1 K, rejecting the heat to the heat sink 174, e.g., at 1 K.

3. Open both heat switches 152, 162 and move piston 134 to an intermediate position, adiabatically expanding the $^3$He in volume 136 to lower its temperature, e.g., from 1 K to 0.05 K.

4. Close heat switch 152 by passing current through solenoid 156 and move piston 134 to fully expand the $^3$He in volume 136 isothermally, e.g. at 0.05 K, absorbing heat from the refrigeration load 172, e.g., at 0.05 K. Thus, the STR can operate on a classical Carnot cycle for refrigeration.

The foregoing description of preferred embodiments of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A refrigerator for cryogenic cooling, comprising:

a single phase working solution of liquid $^3He$ at a predetermined initial concentration in superfluid $^4He$;

a bulk fluid containing superfluid $^4He$;

first pump means defining a first variable volume for containing said working solution, a second variable volume for containing said bulk fluid, and means for cyclically transferring said bulk fluid between said first and second variable volumes;

first superleak means connecting said first and second variable volumes to permit said bulk fluid in said second variable volume to pass therethrough and cyclically vary said concentration of $^3He$ in said first volume for cyclically heating and cooling said working solution in said first volume; and at least one heat exchanger operatively connected with said first volume for thermal energy exchange with said working solution.

2. A refrigerator according to claim 1, further including a regenerator having a first end operatively connected to said first pump means for transferring said solution from said first volume and a second end for receiving said working solution.

3. A refrigerator according to claim 2, further including:

second pump means operatively connected to said second end of said regenerator and defining a third variable volume for receiving said working solution and a fourth variable volume for containing said bulk fluid;

second superleak means connecting said third and fourth variable volumes for cyclically varying said concentration of $^3He$ in said third volume; and at least one heat exchanger operatively connected with said third volume for thermal energy exchange with said working solution.

4. A refrigerator according to claim 3, wherein each said superleak means comprises:

a piston defining an opening therethrough; and a superleak material filling said opening to enable $^4He$ to pass while blocking the passage of $^3He$.

5. A refrigerator according to claim 2, wherein each said superleak means comprises:

a piston defining an opening therethrough; and a superleak material filling said opening to enable $^4He$ to pass while blocking the passage of $^3He$.

6. A refrigerator according to claim 1, wherein each said superleak means comprises:

a piston defining an opening therethrough; and a superleak material filling said opening to enable $^4He$ to pass while blocking the passage of $^3He$.

7. A refrigerator according to claim 4, further including a shaft attached to each said piston for independently reciprocating said piston.

8. A refrigerator according to claim 1, wherein said at least one heat exchanger further comprises:

a first thermal switch for connecting said working solution to a refrigeration load when said first volume is expanding; and a second thermal switch for connecting said working solution to a heat sink when said first volume is compressing.

9. A refrigerator according to claim 8, wherein said first and second thermal switches are each comprised of a superconducting material.

10. A Stirling cycle refrigerator having a compressor, an expander, a regenerator therebetween and a working fluid for cooling said expander, wherein the improvement is a working fluid comprising a single phase solution of liquid $^3He$ at a selected initial concentration in superfluid $^4He$.

11. A Stirling cycle refrigerator according to claim 10, wherein said compressor and said expander each comprise:

a single phase working solution of liquid $^3He$ at a predetermined initial concentration in superfluid $^4He$;

a bulk fluid containing superfluid $^4He$;

first pump means defining a first variable volume for containing said working solution, a second variable volume for containing said bulk fluid, and means for cyclically transferring said bulk fluid between said first and second variable volumes;

first superleak means connecting said first and second variable volumes to permit said bulk fluid in said second variable volume to pass therethrough and cyclically vary said concentration of $^3He$ in said first volume for cyclically heating and cooling said working solution in said first volume; and at least one heat exchanger operatively connected with said first volume for thermal energy exchange with said working solution.

12. A Stirling cycle refrigerator according to claim 11, wherein each superleak means comprises:

a piston defining an opening therethrough; and a superleak material filling said opening to enable $^4He$ to pass while blocking the passage of $^3He$.

13. A Stirling cycle refrigerator according to claim 12, further including a shaft attached to each said piston for independently reciprocating said piston.

14. A Stirling cycle refrigerator according to claim 10, wherein said expander is an orificed pulse tube.

15. A method for cryogenic cooling, comprising:

providing in a first volume a single phase solution of liquid $^3He$ at a selected initial concentration in superfluid $^4He$;

cyclically varying said concentration of $^3He$ in said first volume while maintaining said single phase solution for cyclically heating and cooling said solution in said first volume.

16. A method according to claim 15, wherein the step of cyclically varying said concentration of $^3He$ in said first volume includes the step of cyclically expanding and contracting said first volume.

17. A method according to claim 15, where cyclically heating and cooling said solution in said first volume is a Stirling cycle.

18. A method according to claim 15, where cyclically heating and cooling said solution in said first volume is a Carnot cycle.

* * * * *